US010450039B2

(12) United States Patent
Okafuji et al.

(10) Patent No.: US 10,450,039 B2
(45) Date of Patent: Oct. 22, 2019

(54) NON-SPHERICAL TANK AND LIQUEFIED GAS CARRIER SHIP EQUIPPED WITH THE NON-SPHERICAL TANKS

(71) Applicant: MITSUBISHI HEAVY INDUSTRIES, LTD., Tokyo (JP)

(72) Inventors: Takashi Okafuji, Tokyo (JP); Kazuhiro Hirota, Tokyo (JP); Ryusuke Takada, Tokyo (JP); Michihisa Watanabe, Tokyo (JP); Kazuhiro Miura, Tokyo (JP)

(73) Assignee: MITSUBISHI SHIPBUILDING CO., LTD., Yokohama-Shi, Kanagawa (JP)

( * ) Notice: Subject to any disclaimer, the term of this patent is extended or adjusted under 35 U.S.C. 154(b) by 0 days.

(21) Appl. No.: 15/563,821

(22) PCT Filed: Mar. 15, 2016

(86) PCT No.: PCT/JP2016/058201
§ 371 (c)(1),
(2) Date: Oct. 2, 2017

(87) PCT Pub. No.: WO2016/163209
PCT Pub. Date: Oct. 13, 2016

(65) Prior Publication Data

US 2018/0072387 A1 Mar. 15, 2018

(30) Foreign Application Priority Data

Apr. 10, 2015 (JP) ..... 2015-080865

(51) Int. Cl.
*B63B 25/16* (2006.01)
*F17C 3/00* (2006.01)
(Continued)

(52) U.S. Cl.
CPC ..... *B63B 25/16* (2013.01); *B63B 3/14* (2013.01); *F17C 3/00* (2013.01); *F17C 13/08* (2013.01); *B63B 2025/087* (2013.01)

(58) Field of Classification Search
CPC ..... B63B 25/16; F17C 2270/0105; F17C 2201/0128; F17C 13/082; F17C 2201/0133
See application file for complete search history.

(56) References Cited

U.S. PATENT DOCUMENTS 3,438,532 A * 4/1969 Chibaeff ..... F17C 1/02 220/565
3,859,805 A * 1/1975 Johnson ..... B63B 25/12 62/45.1
(Continued)

FOREIGN PATENT DOCUMENTS

JP H03-128791 A 5/1991
JP H04-087895 A 3/1992
(Continued)

OTHER PUBLICATIONS

PCT/ISA/210, "International Search Report for International Application No. PCT/JP2016/058201," dated Jun. 21, 2016.
(Continued)

*Primary Examiner* — Andrew Polay
(74) *Attorney, Agent, or Firm* — Manabu Kanesaka; Kenneth m. Berner; Benjamin Hauptman

(57) ABSTRACT

To provide a non-spherical tank which includes: a circular cylindrical portion; a top portion disposed continuously with an upper side of the circular cylindrical portion; and a bottom portion disposed continuously with a lower side of the circular cylindrical portion, wherein the top portion includes: a spherical shell portion which is formed of a portion of a spherical body having a radius R1, and is disposed at an upper end of the top portion; and a toroidal
(Continued)

portion which is disposed continuously with the upper side of the circular cylindrical portion and with a lower side of the spherical shell portion respectively, and is formed of a portion of a spherical body having a radius R2 smaller than the radius R1, and an expression 1.0<R/H1<1.5 is satisfied. Here, "R" denotes a radius of the circular cylindrical portion, and "H1" denotes a height of the top portion in a vertical direction.

5 Claims, 8 Drawing Sheets

(51) Int. Cl.

| | |
|---|---|
| ***F17C 13/08*** | (2006.01) |
| ***B63B 3/14*** | (2006.01) |
| *B63B 25/08* | (2006.01) |

(56) References Cited

U.S. PATENT DOCUMENTS

| | | | |
|---|---|---|---|
| 5,099,779 | A | 3/1992 | Kawaichi et al. |
| 2016/0068235 | A1 | 3/2016 | Ohtsuka et al. |

FOREIGN PATENT DOCUMENTS

| | | | | |
|---|---|---|---|---|
| JP | 2008-273609 | A | 11/2008 | |
| JP | 2009-540233 | A | 11/2009 | |
| JP | 2012-056429 | A | 3/2012 | |
| JP | 2013-007486 | A | 1/2013 | |
| WO | 2007/142400 | A1 | 12/2007 | |
| WO | 2012/032983 | A1 | 3/2012 | |
| WO | WO-2012032983 | A1 * | 3/2012 | ..... B63B 3/48 |
| WO | 2014/203742 | A1 | 12/2014 | |

OTHER PUBLICATIONS

PCT/ISA/237, "Written Opinion of the International Searching Authority for International Application No. PCT/JP2016/058201," dated Jun. 21, 2016.

* cited by examiner

NON-SPHERICAL TANK AND LIQUEFIED GAS CARRIER SHIP EQUIPPED WITH THE NON-SPHERICAL TANKS

RELATED APPLICATIONS

The present application is National Phase of International Application No. PCT/JP2016/058201 filed Mar. 15, 2016, and claims priority from Japanese Application No. 2015-080865, filed Apr. 10, 2015, the disclosure of which is hereby incorporated by reference herein in its entirety.

TECHNICAL FIELD

The present invention relates to a non-spherical tank and a liquefied gas carrier ship equipped with the non-spherical tanks.

BACKGROUND ART

Conventionally, as a liquefied gas carrier ship which carries a liquefied natural gas (LNG) in a state where the gas is stored in a tank, there is known a liquefied gas carrier ship which includes a plurality of tanks disposed along the bow-stern direction, and one continuous tank cover which covers upper half portions of the plurality of tanks (see patent citation 1, for example).

Each flat spherical tank disclosed in patent citation 1 includes a circular cylindrical portion and a top portion continuously formed with the circular cylindrical portion above an equator portion. In patent citation 1, the flat spherical tank is configured such that, if a radius of the circular cylindrical portion is "R", and a length of the top portion in the vertical direction is "H1", an equation R/H1=1.5 is established. When the flat spherical tank is formed into such a shape, compared to a spherical tank having the same height, a large capacity can be maintained and, at the same time, wind pressure resistance can be reduced.

Patent Citation 1: Japanese Unexamined Patent Application, Publication No. 2012-56429

SUMMARY OF INVENTION

A flat spherical tank in which a liquefied natural gas is stored is filled with a natural gas or the like evaporated by external heat input. Accordingly, internal pressure is applied to an inside surface of the flat spherical tank by the natural gas or the like filled in the inside of the flat spherical tank. Further, external pressure is applied to an outside surface of the flat spherical tank by the atmosphere. The flat spherical tank is formed of a plurality of portions respectively having different curvatures and hence, a large stress caused by internal pressure and external pressure is generated particularly on portions having a small curvature. When a portion does not possess sufficient buckling resistance to the stress, there is a possibility that buckling occurs at such a portion having a small curvature.

The inventors have studied buckling resistance to stress, and found that when a flat spherical tank is designed such that an equation R/H1=1.5 is established as shown in patent citation 1, a flat spherical tank does not possess sufficient buckling resistance.

The present invention is made in view of such circumstances, and it is an object of the present invention to provide a non-spherical tank where sufficient buckling resistance is ensured and a sufficient capacity is maintained compared to a spherical tank, and a liquefied gas carrier ship equipped with the non-spherical tanks.

To achieve the above-mentioned object, the present invention adopts the following means.

A non-spherical tank according to one aspect of the present invention is a non-spherical tank for storing a liquefied gas, the non-spherical tank including: a circular cylindrical portion extending along a vertical direction and having a cylindrical shape; a top portion having a head plate structure where the top portion is disposed continuously with an upper side of the circular cylindrical portion and projects upward; and a bottom portion having a head plate structure where the bottom portion is disposed continuously with a lower side of the circular cylindrical portion and projects downward, wherein the top portion includes: a top-portion-side spherical shell portion which is formed of a portion of a spherical body having a first radius, and is disposed at an upper end of the top portion; and a top-portion-side toroidal portion which is disposed continuously with the upper side of the circular cylindrical portion and with a lower side of the top-portion-side spherical shell portion, and is formed of a portion of a spherical body having a second radius smaller than the first radius, and a following conditional expression is satisfied.

$$1.0<R/H1<1.5 \quad (1)$$

Here, "R" denotes a radius of the circular cylindrical portion, and "H1" denotes a height of the top portion in the vertical direction.

According to the non-spherical tank of one aspect of the present invention, the radius of the top-portion-side toroidal portion is smaller than the radius of the top-portion-side spherical shell portion, and hence stress is generated in the vicinity of the top-portion-side toroidal portion. If the radius of the circular cylindrical portion is "R" and the height of the top portion in the vertical direction is "H1", the non-spherical tank according to this aspect has a shape where the expression 1.0<R/H1<1.5 is established.

The inventors have performed a stress analysis using a finite element method based on large deformation theory, and found that when a non-spherical tank is formed into a shape where an expression R/H1<1.5 is established, the non-spherical tank possesses sufficient buckling resistance to stress generated in the vicinity of the top-portion-side toroidal portion. When a non-spherical tank is formed into a shape where an expression R/H1>1.0 is established, the non-spherical tank can maintain a sufficient capacity compared to a spherical tank.

As described above, according to the non-spherical tank of one aspect of the present invention, it is possible to provide the non-spherical tank where sufficient buckling resistance is ensured and a sufficient capacity is maintained compared to a spherical tank.

The non-spherical tank according to one aspect of the present invention may be configured such that a center position of the spherical body having the first radius which forms the top-portion-side spherical shell portion is disposed on an extension of a line which connects a connecting position at which the top-portion-side spherical shell portion and the top-portion-side toroidal portion are connected with each other and a center position of the spherical body having the second radius which forms the top-portion-side toroidal portion.

According to this configuration, at the connecting position at which the top-portion-side spherical shell portion and the top-portion-side toroidal portion are connected with each other, the tangential direction of the top-portion-side spherical shell portion and the tangential direction of the top-portion-side toroidal portion agree with each other. Accordingly, the top-portion-side spherical shell portion and the top-portion-side toroidal portion are smoothly connected with each other at the connecting position of these portions.

With such a configuration, it is possible to suppress the problem where stress is concentrated at the connecting position at which the top-portion-side spherical shell portion and the top-portion-side toroidal portion are connected with each other.

The non-spherical tank according to one aspect of the present invention may be configured such that a following conditional expression is satisfied.

$$1.0 \leq R/H2 < 1.5 \quad (2)$$

Here, "H2" denotes a height of the bottom portion in the vertical direction.

According to the non-spherical tank having this configuration, if the radius of the circular cylindrical portion is "R" and the height of the bottom portion in the vertical direction is "H2", the non-spherical tank has a shape where the expression 1.0≤R/H2<1.5 is established.

The inventors have performed a stress analysis using the finite element method based on large deformation theory, and found that when a non-spherical tank is formed into a shape where an expression R/H2<1.5 is established, the non-spherical tank possesses sufficient buckling resistance to stress generated in the vicinity of the bottom-portion-side toroidal portion. When a flat spherical tank is formed into a shape where an expression R/H2≥1.0 is established, the flat spherical tank can maintain a sufficient capacity compared to a spherical tank.

In the above-mentioned non-spherical tank, the bottom portion may include: a first-bottom-portion-side spherical shell portion which is formed of a portion of a spherical body having a third radius, and is disposed at a lower end of the bottom portion; and a bottom-portion-side toroidal portion which is disposed continuously with an upper side of the first-bottom-portion-side spherical shell portion, and is formed of a portion of a spherical body having a fourth radius smaller than the third radius.

With such a configuration, a lower portion of the circular cylindrical portion is formed into an appropriate non-spherical shape. Accordingly, the non-spherical tank can ensure sufficient buckling resistance and maintain a sufficient capacity compared to a spherical tank.

In the above-mentioned non-spherical tank, a center position of the spherical body having the third radius which forms the first-bottom-portion-side spherical shell portion may be disposed on an extension of a line which connects a connecting position at which the first-bottom-portion-side spherical shell portion and the bottom-portion-side toroidal portion are connected with each other and a center position of the spherical body having the fourth radius which forms the bottom-portion-side toroidal portion.

According to the non-spherical tank having such a configuration, at the connecting position at which the first-bottom-portion-side spherical shell portion and the bottom-portion-side toroidal portion are connected with each other, the tangential direction of the first-bottom-portion-side spherical shell portion and the tangential direction of the bottom-portion-side toroidal portion agree with each other. Accordingly, the first-bottom-portion-side spherical shell portion and the bottom-portion-side toroidal portion are smoothly connected with each other at the connecting position of these portions.

With such a configuration, it is possible to suppress the problem where stress is concentrated at the connecting position at which the first-bottom-portion-side spherical shell portion and the bottom-portion-side toroidal portion are connected with each other.

In the non-spherical tank according to one aspect of the present invention, following conditional expressions may be satisfied.

$$R1/R2 < 2.5 \quad (3)$$

$$R2/R > 0.4 \quad (4)$$

Here, "R1" denotes the first radius, and "R2" denotes the second radius.

The inventors have performed a stress analysis using the finite element method based on large deformation theory, and found that when a non-spherical tank is formed into a shape where the above-mentioned conditional expressions (3) and (4) are satisfied, the non-spherical tank possesses reliable buckling resistance to stress generated in the vicinity of the top-portion-side toroidal portion. With such a configuration, it is possible to suppress the problem where stress is concentrated at the connecting position at which the top-portion-side spherical shell portion and the top-portion-side toroidal portion are connected with each other.

A liquefied gas carrier ship according to one aspect of the present invention includes: any of the above-mentioned non-spherical tanks; and a tank cover covering an upper half portion of the non-spherical tanks, and extending along a bow-stern direction and along a ship width direction.

With such a configuration, it is possible to provide a liquefied gas carrier ship equipped with the non-spherical tanks where sufficient buckling resistance is ensured and a sufficient capacity is maintained compared to a spherical tank.

According to the present invention, it is possible to provide a non-spherical tank where sufficient buckling resistance is ensured and a sufficient capacity is maintained compared to a spherical tank, and a liquefied gas carrier ship equipped with the non-spherical tanks.

DESCRIPTION OF EMBODIMENTS

Hereinafter, a liquefied gas carrier ship according to one embodiment of the present invention is described with reference to drawings.

As shown in FIG. 1A, FIG. 1B, FIG. 3A and FIG. 3B, a liquefied gas carrier ship ("LNG ship" in this embodiment) 1 according to this embodiment is a ship equipped with four non-spherical tanks (also referred to as "flat spherical tanks") 2 made of aluminum, for example. The respective non-spherical tanks 2 made of aluminum are configured to store a liquefied gas (a natural gas liquefied at a low temperature in this embodiment) in the inside thereof.

Figure 2:
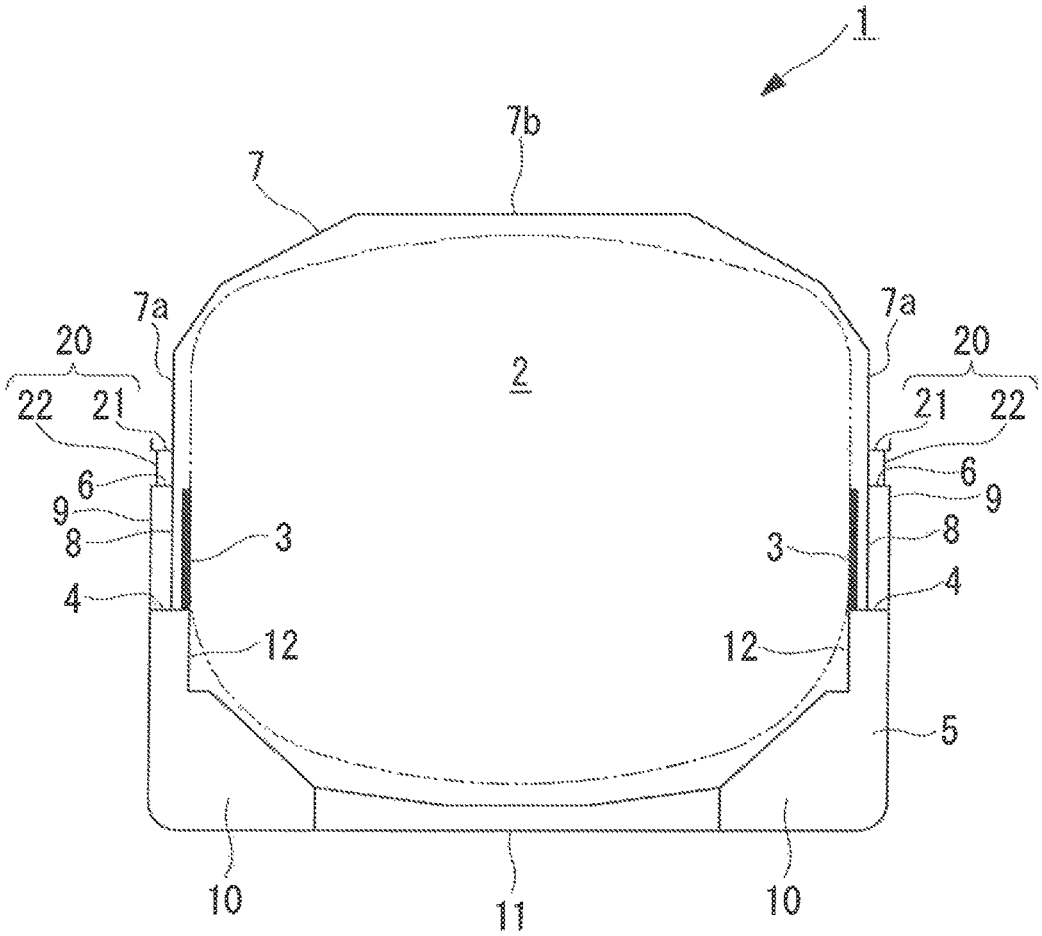
FIG. 2 FIG. 2 is a cross-sectional view taken along line II-II in FIG. 1A.
Figure 3A:
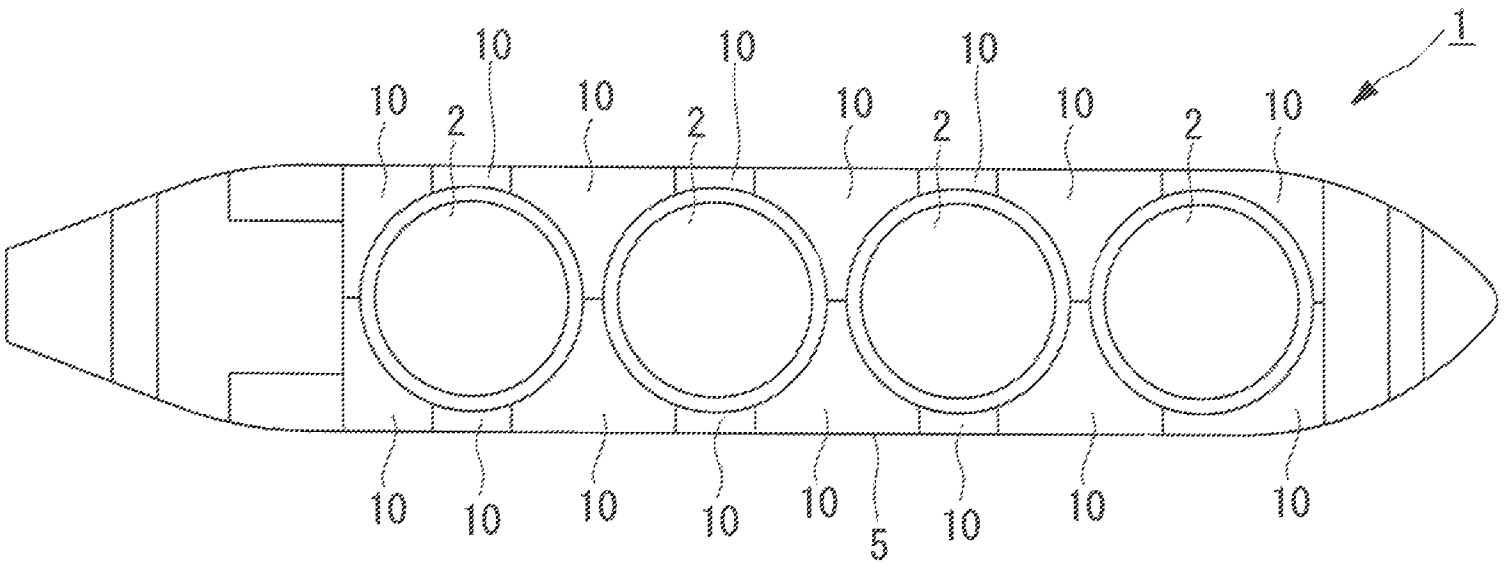
FIG. 3A is a view of the liquefied gas carrier ship according to one embodiment of the present invention, and is also a cross-sectional view taken along line A-A in FIG. 1A.
Figure 3B:
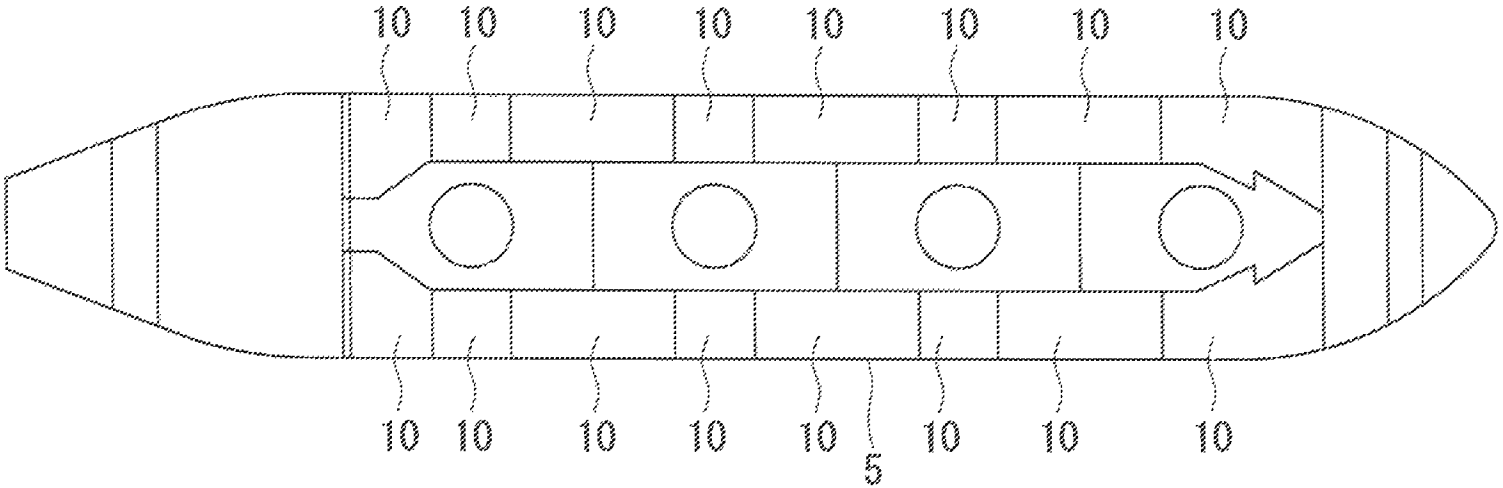
FIG. 3B is a view of the liquefied gas carrier ship according to one embodiment of the present invention, and is also a cross-sectional view taken along line B-B in FIG. 1A.

As shown in FIG. 2, these non-spherical tanks 2 are respectively supported on a hull 5 by way of cylindrical skirts 3. A lower end portion of each skirt 3 is fixed to a foundation deck 4 such that an upper end portion of each skirt 3 is disposed at an equator position of the non-spherical tank 2. As described above, weights of the non-spherical tanks 2 are received by the hull 5 by way of the skirts 3.

In this embodiment, the equator position means a lower end position of a circular cylindrical portion 31 described later. The circular cylindrical portion 31 is connected to the upper end portion of the skirt 3 at the lower end position of the circular cylindrical portion 31.

Figure 1A:
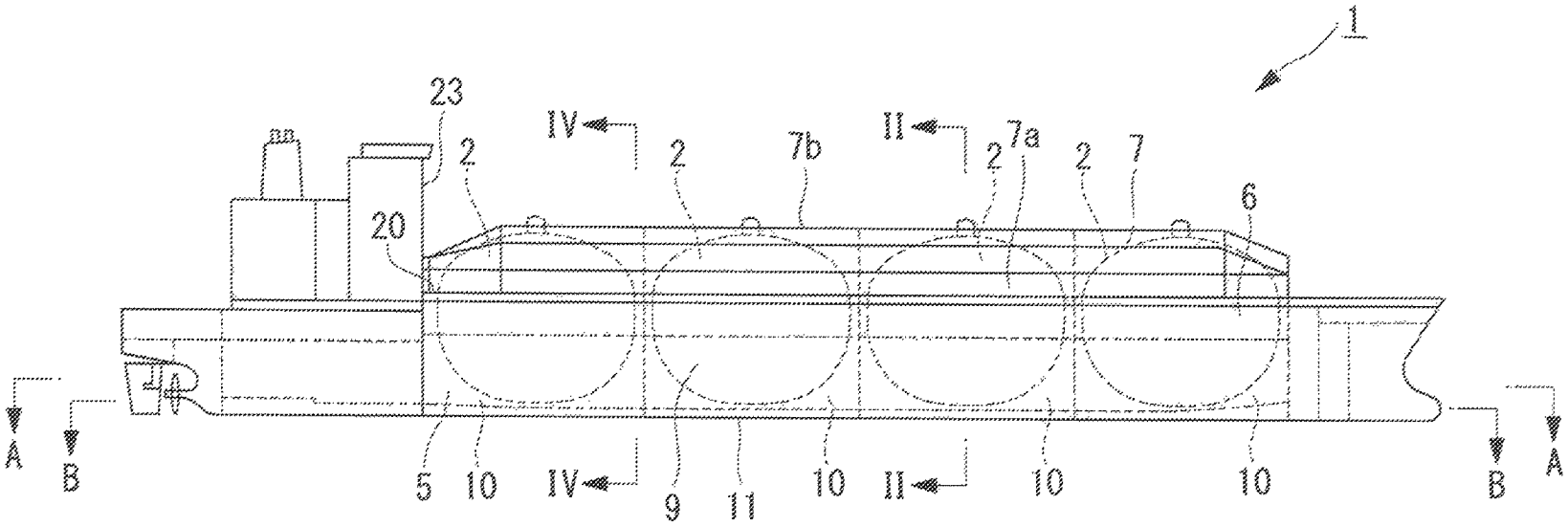
FIG. 1A is a right side view of a liquefied gas carrier ship according to one embodiment of the present invention.
Figure 1B:
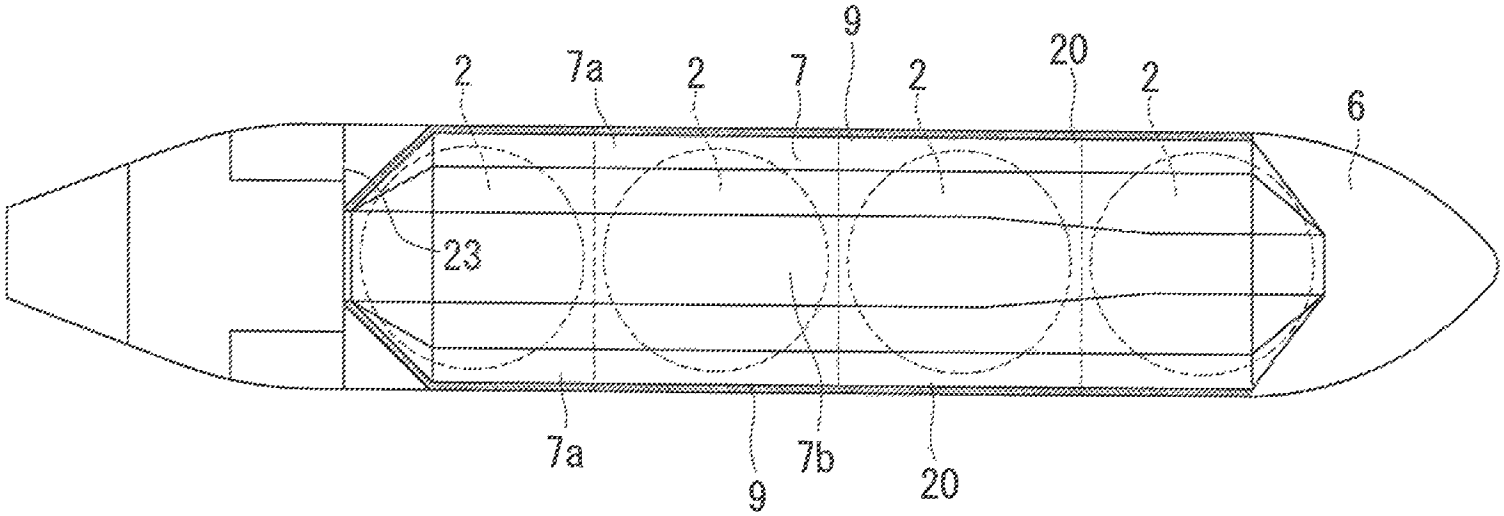
FIG. 1B is a plan view of the liquefied gas carrier ship according to one embodiment of the present invention.

As shown in FIG. 1A, FIG. 1B, and FIG. 2, upper half portions of these non-spherical tanks 2 are covered by a tank cover 7 having a top surface 7*b*. The tank cover 7 is one continuous member which has a lower end portion thereof fixed to an upper deck 6, and extends along the bow-stern direction and along the ship width direction.

No expansion joint is provided between the tank cover 7 and the upper deck 6, and the tank cover 7 has a rigid structure. That is, the tank cover 7, in conjunction with the hull 5, constitutes a structure which ensures longitudinal strength of a ship as required by rules or the like of Classification Society. In this embodiment, the longitudinal strength means strength of a ship against a bending force and a shearing force caused due to its own weight, cargo loaded on the ship and a force of waves in the bow-stern direction (longitudinal direction). In FIG. 2, reference numerals "8" and "9" denote a longitudinal bulkhead and a side shell plating respectively.

As shown in FIG. 1A to FIG. 4, a plurality of (seventeen in this embodiment) ballast tanks 10 are provided on a ship bottom portion of the hull 5 along the bow-stern direction and along the ship width direction.

Of these ballast tanks 10, the ballast tanks 10 other than the ballast tank 10 disposed at a position closest to a bow, each include a wall portion 12 forming an upper portion of each ballast tank 10. The wall portions 12 are arranged along the circumferential direction of the non-spherical tanks 2 and, simultaneously, surround upper sides of bottom portions of the non-spherical tanks 2. Lower portions of the ballast tanks 10 are arranged in the bow-stern direction along the side shell platings 9 and a ship bottom (bottom shell plating) 11 of the hull 5.

The wall portions 12 forming the upper portions of the ballast tanks 10 are arranged along the circumferential direction of the non-spherical tanks 2 and, simultaneously, surround the upper sides of the bottom portions of the non-spherical tanks 2. Accordingly, the upper portions of these ballast tanks 10 can be also used as portions of the skirts 3 which support the non-spherical tanks 2. As a result, a total amount of a material for forming the skirts 3 can be reduced so that a construction cost can be reduced.

As shown in FIG. 1A, FIG. 1B, FIG. 2, and FIG. 4, on the port side and the starboard side of the liquefied gas carrier ship 1 according to this embodiment, one walkway (passage) 20 is provided along each of the side shell platings 9.

The walkways 20 act as passages to which a gangway ladder (accommodation ladder) is connected, which is installed in a terminal (not shown in the drawing) docked for performing loading/unloading work. The walkways 20 also act as passages through which crew, operators and the like come and go.

Figure 4:
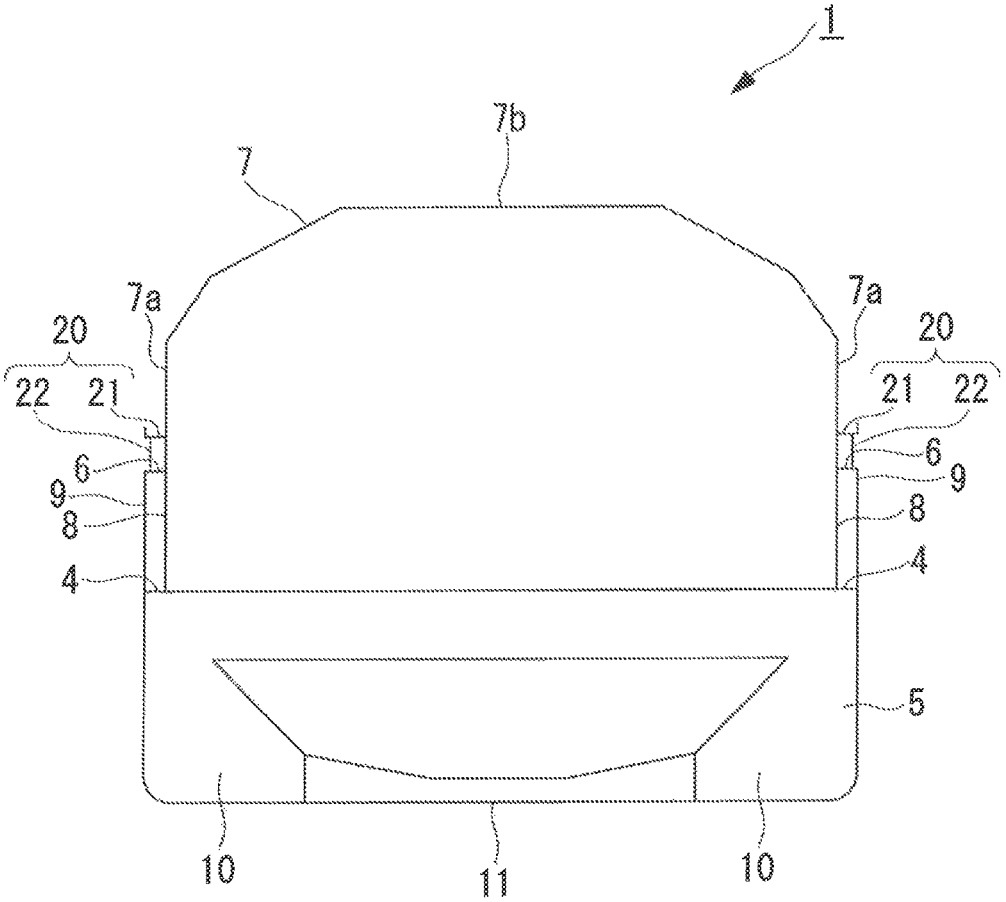
FIG. 4 is a cross-sectional view taken along line IV-IV in FIG. 1A.

As shown in FIG. 2 and FIG. 4, each walkway 20 includes a walking deck 21 extending toward the outside from a side surface 7*a* of the tank cover 7 and a plurality of support members 22 extending upward in the vertical direction from the upper deck 6 (or obliquely upward from the side surface 7*a* of the tank cover 7) so as to support a lower surface of the walking deck 21.

As shown in FIG. 1A and FIG. 1B, each walkway 20 extends from a front surface of a house (residential zone) 23 to a front end of the side surface 7*a* of the tank cover 7 along the corresponding side shell plating 9. Further, stairs (not shown in the drawing) are respectively provided at both ends (a left end and a right end in FIG. 1A and FIG. 1B) of each walking deck 21. The stairs allow crew to descend to the upper deck 6 from the walking deck 21 or to ascend to the walking deck 21 from the upper deck 6.

A height (vertical distance) L (m) from the ship bottom 11 to an upper surface of the walking deck 21 is set to a height, within a range larger than a value of "height D (m)+2 (m)" (height D being from the ship bottom 11 to the upper surface of the upper deck 6) and smaller than 40 (m), which allows all of the gangway ladders installed at terminals at which the ship is scheduled to dock (after entering service) to be connected to the walkway 20.

In this embodiment, a gangway ladder is to be connected to an upper surface of the walkway 20 disposed in conformity with a movable range of the gangway ladder installed at a terminal at which the ship is scheduled to dock. Accordingly, even when the upper deck 6 is disposed at a low position, all of the gangway ladders installed at terminals at which the ship is scheduled to dock can be connected to the walkway 20. As a result, the ship can possess favorable compatibility with respect to the gangway ladders installed at terminals.

Next, a shape of the non-spherical tank 2 of this embodiment is described with reference to FIG. 5 and FIG. 6.

Figure 5:
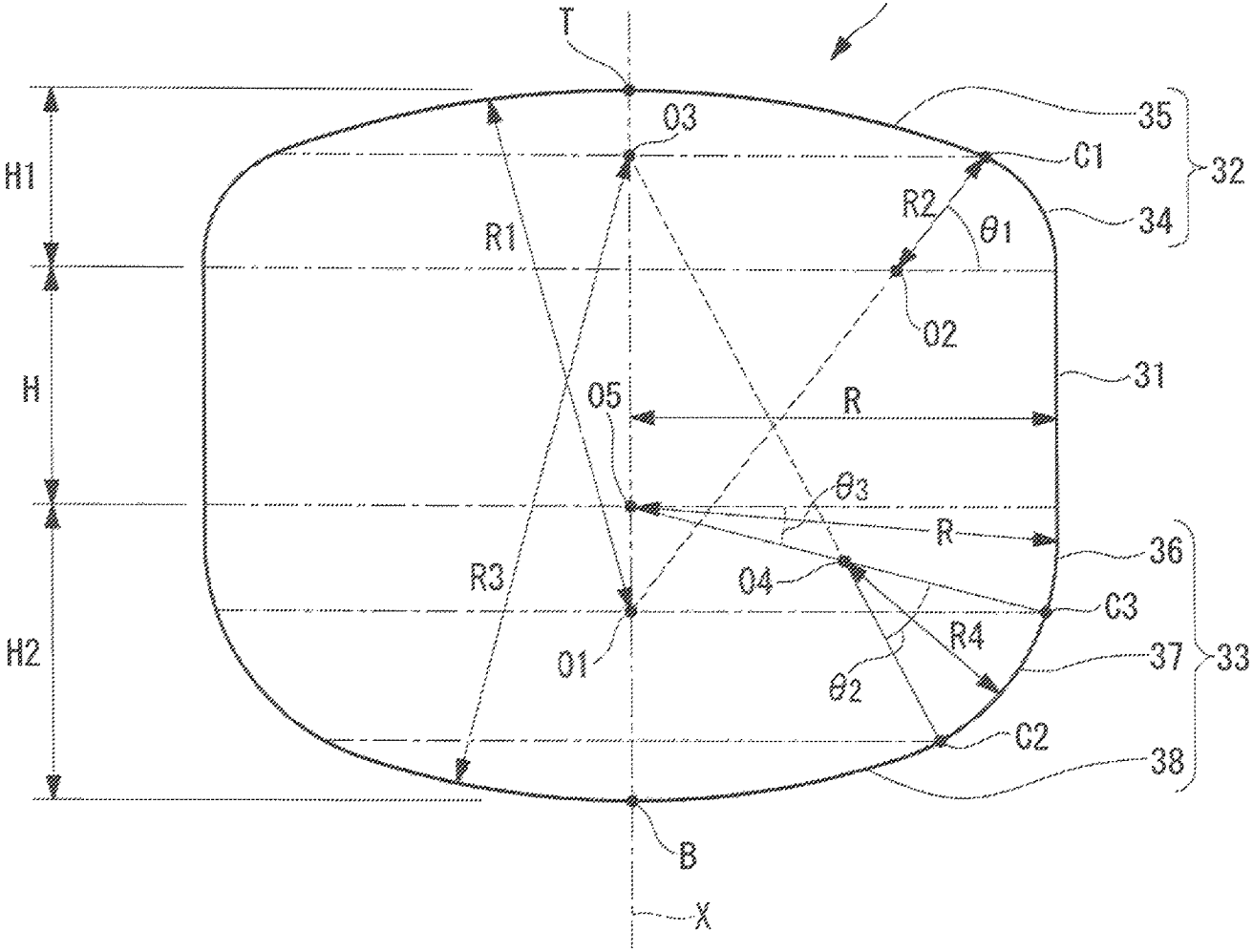
FIG. 5 is a side view showing a flat spherical tank.

As shown in FIG. 5, the non-spherical tank 2 has a flat spherical shape where a length of the non-spherical tank 2 in the vertical direction (H+H1+H2) is shorter than a diameter (2·R) of the circular cylindrical portion 31. The non-spherical tank 2 is a tank having a spherical shape which is flattened compared to a true sphere so that a shape is slightly approximated to a square shape. In other words, the non-spherical tank 2 is a tank having a shape where only a small amount of useless space is generated inside the hull 5, and a projection amount of the non-spherical tank 2 in the upward direction from the hull 5 is not small.

The length of the non-spherical tank 2 in the vertical direction (H+H1+H2) may be set to a value which falls within a range shorter than 2.5 times a radius of the circular cylindrical portion 31 (2.5·R).

As shown in FIG. 5, the non-spherical tank 2 includes the circular cylindrical portion 31, a top portion 32, and a bottom portion 33.

The circular cylindrical portion 31 is a portion having a cylindrical shape which extends in the direction along an axis X (vertical direction). The radius of the circular cylindrical portion 31 about the axis X is set to "R".

The top portion 32 has a head plate structure where the top portion 32 is disposed continuously with an upper side of the circular cylindrical portion 31, and projects upward along the axis X. A height of the top portion 32 in the vertical direction is set to "H1". The top portion 32 includes a toroidal portion 34 (top-portion-side toroidal portion) and a spherical shell portion 35 (top-portion-side spherical shell portion).

The spherical shell portion 35 is a portion which is formed of a portion of a spherical body having a radius R1 (first radius), and is disposed at an upper end T of the top portion 32.

The toroidal portion 34 is a portion which is formed of a portion of a spherical body having a radius R2 (second radius), and is disposed continuously with the upper side of the circular cylindrical portion 31 and with a lower side of the spherical shell portion 35 respectively. The radius R2 of the spherical body forming the toroidal portion 34 is set smaller than the radius R1 of the spherical body forming the spherical shell portion 35.

As shown in FIG. 5, a center position O1 of the spherical body having the radius R1 which forms the spherical shell portion 35 is disposed on an extension of a line which connects a connecting position C1 at which the spherical shell portion 35 and the toroidal portion 34 are connected with each other and a center position O2 of the spherical body having the radius R2 which forms the toroidal portion 34.

The bottom portion 33 has a head plate structure where the bottom portion 33 is disposed continuously with a lower side of the circular cylindrical portion 31, and projects downward along the axis X. A height of the bottom portion 33 in the vertical direction is set to "H2". The bottom portion 33 includes a first spherical shell portion 38 (first-bottom-portion-side spherical shell portion), a toroidal portion 37, and a second spherical shell portion 36 (second-bottom-portion-side spherical shell portion).

The first spherical shell portion 38 is a portion which is formed of a portion of a spherical body having a radius R3 (third radius), and is disposed at a lower end B of the bottom portion 33.

The second spherical shell portion 36 is a portion which is formed of a portion of a spherical body having the same radius as the radius R of the circular cylindrical portion 31, and is disposed continuously with the lower side of the circular cylindrical portion 31.

The toroidal portion 37 is a portion which is formed of a portion of a spherical body having a radius R4 (fourth radius), and is disposed continuously with an upper side of the first spherical shell portion 38 and with a lower side of the second spherical shell portion 36 respectively. The radius R4 of the spherical body forming the toroidal portion 37 is set smaller than the radius R3 of the spherical body forming the first spherical shell portion 38.

As shown in FIG. 5, a center position O3 of the spherical body having the radius R3 which forms the first spherical shell portion 38 is disposed on an extension of a line which connects a connecting position C2 at which the first spherical shell portion 38 and the toroidal portion 37 are connected with each other and a center position O4 of the spherical body having the radius R4 which forms the toroidal portion 37.

Further, as shown in FIG. 5, a center position O5 of the spherical body having the radius R which forms the second spherical shell portion 36 is disposed on an extension of a line which connects a connecting position C3 at which the second spherical shell portion 36 and the toroidal portion 37 are connected with each other and the center position O4 of the spherical body having the radius R4 which forms the toroidal portion 37.

In this embodiment, if a central angle of the spherical body having the radius R2 which forms the toroidal portion 34 of the top portion 32 is "θ1", the following equation (1) is established.

$$R=R1\cdot\cos\theta1+R2\cdot(1-\cos\theta1) \quad (1)$$

Here, if R2=α·R and R1=β·R, the equation (1) is transformed into the following equation (2).

$$R=\beta\cdot R\cdot\cos\theta1+\alpha\cdot R(1-\cos\theta1) \quad (2)$$

When the equation (2) is transformed, the following equation (3) is established.

$$\beta=(1-\alpha+\alpha\cdot\cos\theta1)/\cos\theta1 \quad (3)$$

As described above, the radius R2 is equal to α·R (R2=α·R) and the radius R1 is equal to β·R (R1=β·R) so that the following equation (4) is established.

$$\beta/\alpha=R1/R2 \quad (4)$$

In this manner, "β" is a function of "α" and "θ1" so that when "α" and "θ1" are determined, a value of "β" is then determined.

With respect to the height H1 of the top portion 32, the following equation (5) is established.

$$H1=R1-(R1-R2)\cdot\cos(90°-\theta1) \quad (5)$$

Based on the relationships R2=α·R and R1=β·R, the equation (5) is transformed into the following equation (6).

$$H1=\beta\cdot R-(\beta\cdot R-\alpha\cdot R)\cdot\cos(90°-\theta1) \quad (6)$$

As described above, "β" is a function of "α" and "θ1". Accordingly, the height H1 of the top portion 32 is also a function of "α" and "θ1".

In designing a shape of the top portion 32 of the non-spherical tank 2, the more the shape of the top portion 32 is approximated to a true sphere, the lower the compression stress becomes. Accordingly, a capacity of the non-spherical tank 2 is reduced. On the other hand, the more the shape of the top portion 32 is approximated to a square shape, the greater the compression stress becomes. Accordingly, the capacity of the non-spherical tank 2 is increased.

That is, the larger a value of an expression R/H1 shown in FIG. 5 becomes (the shorter the height H1 of the top portion 32 with respect to the radius of the circular cylindrical portion 31 becomes), the larger a capacity of the non-spherical tank 2 becomes. However, in such a case, compression stress is also increased.

Accordingly, it is desirable to design a shape of the non-spherical tank 2 such that a value of the expression R/H1 is increased within a range where the non-spherical tank 2 can ensure sufficient buckling resistance to compression stress.

The inventors have analyzed compression stress using a finite element method based on large deformation theory. As a result, the inventors have found that the following expressions (7) and (8) are required to be satisfied so as to allow the non-spherical tank 2 to satisfy buckling resistance to compression stress generated in the vicinity of the toroidal portion 34 of the top portion 32. In the finite element method based on large deformation theory, a stress analysis is performed based on a shape after being deformed due to compression stress so that tolerance of compression stress is large compared to tolerance of compression stress in a finite element method based on infinitesimal deformation theory.

That is, analysis results obtained using the finite element method based on large deformation theory possess larger buckling resistance to compression stress.

$$\alpha>0.4 \quad (7)$$

$$\beta/\alpha<2.5 \quad (8)$$

In this embodiment, the radius R2 is equal to the expression $\alpha\cdot R$ ($R2=\alpha\cdot R$). Accordingly, the expression (7) means that when the radius R2 of the spherical body forming the toroidal portion 34 is not set larger than the radius of the circular cylindrical portion 31 to some extent, buckling occurs in the vicinity of the toroidal portion 34.

Based on the equation (4), an expression $\beta/\alpha$ is equal to an expression R1/R2 ($\beta/\alpha=R1/R2$). Accordingly, the expression (8) means that when the radius R2 of the spherical body forming the toroidal portion 34 is not set larger than the radius R1 of the spherical body forming the spherical shell portion 35 to some extent, buckling occurs in the vicinity of the toroidal portion 34.

As described above, to ensure buckling resistance of the top portion 32, it is necessary to satisfy conditions of the expressions (7) and (8). On the other hand, to increase a capacity, it is necessary to increase a value of the expression R/H1.

Figure 6:
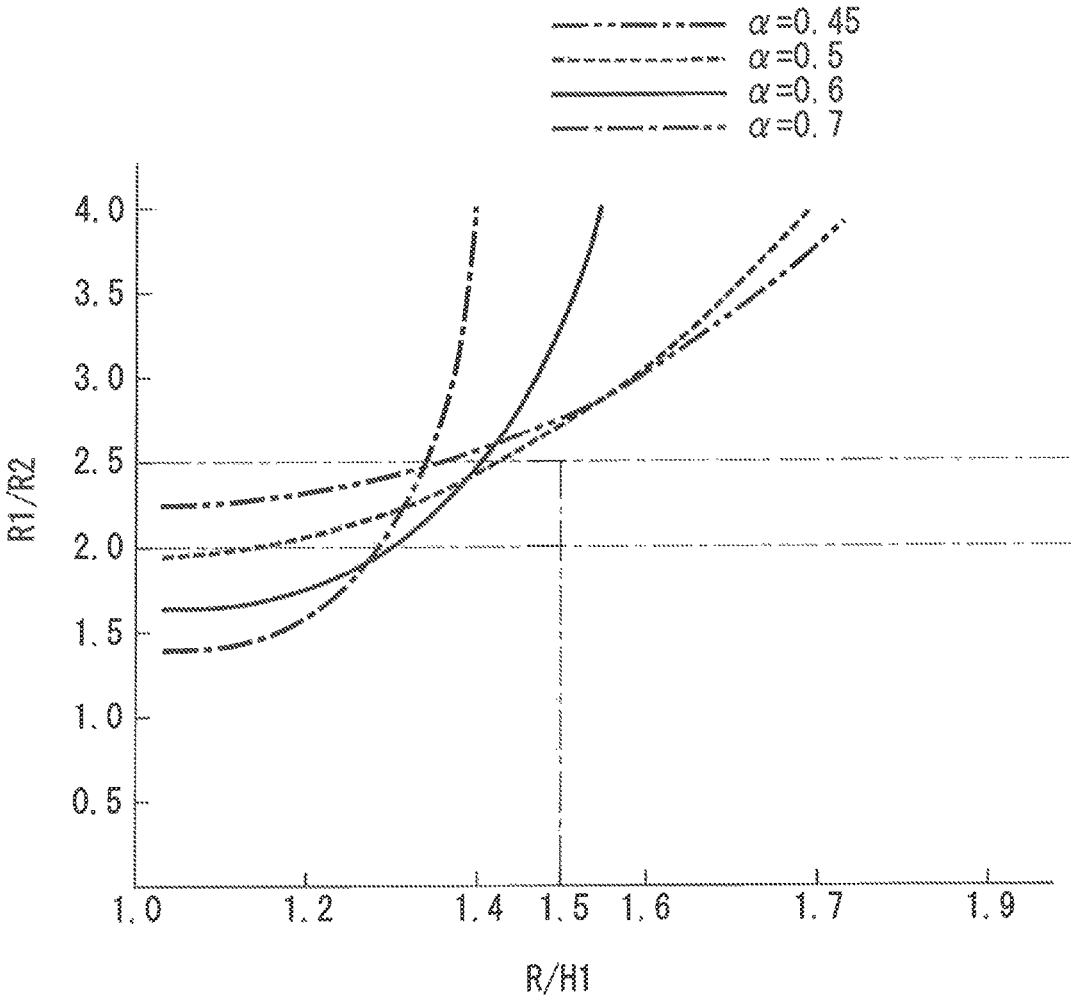
FIG. 6 is a graph showing a relationship of an expression R1/R2 with respect to an expression R/H1.

In view of the above, the inventors or the like have acquired a graph shown in FIG. 6 showing the relationship between the expression R/H1 and the expression R1/R2 (that is, $\beta/\alpha$) by changing values of variables $\alpha$ and $\theta 1$ in the equations (3) and (6).

As shown in FIG. 6, to satisfy the conditions of the expressions (7) and (8), it is necessary to set the expression R/H1 to a value which falls within a range of the following expression (9).

$$1.0<R/H1<1.5 \quad (9)$$

When a non-spherical tank is formed into a shape where an expression R/H1<1.5 is established, the non-spherical tank can possess sufficient buckling resistance to compression stress generated in the vicinity of the toroidal portion 34. When a non-spherical tank is formed into a shape where an expression R/H1>1.0 is established, the non-spherical tank can maintain a sufficient capacity compared to a spherical tank.

To satisfy the conditions of the expressions (7) and (8), it is desirable that the expression R/H1 is set to a value which falls within a range of the following expression (10).

$$1.2\leq R/H1\leq 1.45 \quad (10)$$

When a non-spherical tank is formed into a shape where an expression R/H1≤1.45 is established, the non-spherical tank can possess reliable buckling resistance to compression stress generated in the vicinity of the toroidal portion 34. When a non-spherical tank is formed into a shape where an expression R/H1≥1.2 is established, the non-spherical tank can maintain a larger capacity compared to a spherical tank.

In this embodiment, the radius R2 of the spherical body forming the toroidal portion 34 of the top portion 32 is smaller than the radius R4 of the spherical body forming the toroidal portion 37 of the bottom portion 33. Accordingly, compression stress applied to the toroidal portion 34 of the top portion 32 is larger than compression stress applied to the toroidal portion 37 of the bottom portion 33. For this reason, to evaluate buckling resistance of the non-spherical tank 2 of this embodiment, it is necessary to evaluate buckling resistance to compression stress applied to the toroidal portion 34 of the top portion 32. The radius R4 of the spherical body forming the toroidal portion 37 of the bottom portion 33 is set large so as to allow the non-spherical tank 2 to have a shape which can prevent a contact of the non-spherical tank 2 with the ballast tanks 10.

In this embodiment, if a central angle of the spherical body having the radius R4 which forms the toroidal portion 37 of the bottom portion 33 is "θ2", and a central angle of the spherical body having the radius R which forms the second spherical shell portion 36 of the bottom portion 33 is "θ3", the following equation (11) is established.

$$R\cdot\cos\theta 4=R6\cdot\cos(\theta 4+\theta 5)+R5\cdot(\cos\theta 4-\cos(\theta 4+\theta 5)) \quad (11)$$

Here, if R6=δ·R and R5=γ·R, the equation (11) is transformed into the following equation (12).

$$R\cdot\cos\theta 4=\delta\cdot R\cdot\cos(\theta 4+\theta 5)+\gamma\cdot R\cdot(\cos\theta 4-\cos(\theta 4+\theta 5)) \quad (12)$$

When the equation (12) is transformed, the following equation (13) is established.

$$\delta=(1-\gamma)\cdot\cos\theta 4/\cos(\theta 4+\theta 5)+\gamma \quad (13)$$

In this manner, "δ" is a function of "γ", "θ4" and "θ5" so that when "γ", "θ4" and "θ5" are determined, a value of "δ" is then determined.

In designing a shape of the bottom portion 33 of the non-spherical tank 2, the more the shape of the bottom portion 33 is approximated to a true sphere, the lower the compression stress becomes. Accordingly, a capacity of the non-spherical tank 2 is reduced. On the other hand, the more the shape of the bottom portion 33 is approximated to a square shape, the greater the compression stress becomes. Accordingly, the capacity of the non-spherical tank 2 is increased.

That is, the larger a value of an expression R/H2 shown in FIG. 6 becomes (the shorter the height H2 of the bottom portion 33 with respect to the radius of the circular cylindrical portion 31 becomes), the larger a capacity of the non-spherical tank 2 becomes. However, in such a case, compression stress is also increased.

Accordingly, it is desirable to design a shape of the non-spherical tank 2 such that a value of the expression R/H2 is increased within a range where the non-spherical tank 2 can ensure sufficient buckling resistance to compression stress, and the non-spherical tank 2 is not brought into contact with the ballast tank 10.

The inventors have analyzed compression stress using the finite element method based on large deformation theory also with respect to the bottom portion 33 in the same manner as the top portion 32. As a result, the inventors have found that it is desirable to set the expression R/H2 to a value which falls within a range of the following expression (14).

$$1.0\leq R/H2<1.5 \quad (14)$$

When a non-spherical tank is formed into a shape where an expression R/H2<1.5 is established, the non-spherical tank can possess sufficient buckling resistance to compression stress generated in the vicinity of the toroidal portion 37. When a non-spherical tank is formed into a shape where an expression R/H2≥1.0 is established, the non-spherical tank can maintain a sufficient capacity compared to a spherical tank.

The description is made with respect to the manner of operation and advantageous effects of the above-described non-spherical tank 2 of this embodiment which the liquefied gas carrier ship 1 includes.

According to the non-spherical tank 2 of this embodiment, the radius of the toroidal portion 34 is smaller than the radius of the spherical shell portion 35 and hence, compression stress is generated in the vicinity of the toroidal portion 34. If the radius of the circular cylindrical portion 31 is "R" and the height of the top portion 32 in the vertical direction is "H1", the non-spherical tank 2 of this embodiment has a shape where an expression $1.0<R/H1<1.5$ is established.

The inventors have performed a compression stress analysis using the finite element method based on large deformation theory, and found that when the non-spherical tank 2 is formed into a shape where an expression $R/H1<1.5$ is established, the non-spherical tank 2 possesses sufficient buckling resistance to compression stress generated in the vicinity of the toroidal portion 34. When the non-spherical tank 2 is formed into a shape where an expression $R/H1>1.0$ is established, the non-spherical tank 2 can maintain a sufficient capacity compared to a spherical tank.

As described above, according to the non-spherical tank 2 of this embodiment, sufficient buckling resistance can be ensured and a sufficient capacity can be maintained compared to a spherical tank.

According to the non-spherical tank 2 of this embodiment, at the connecting position C1 at which the spherical shell portion 35 and the toroidal portion 34 are connected with each other, the tangential direction of the spherical shell portion 35 and the tangential direction of the toroidal portion 34 agree with each other. Accordingly, the spherical shell portion 35 and the toroidal portion 34 are smoothly connected with each other at the connecting position C1 of these portions.

With such a configuration, it is possible to suppress the problem where compression stress is concentrated at the connecting position C1 at which the spherical shell portion 35 and the toroidal portion 34 are connected with each other.

According to the non-spherical tank 2 of this embodiment, if the radius of the circular cylindrical portion 31 is "R" and the height of the bottom portion 33 in the vertical direction is "H2", the non-spherical tank 2 has a shape where an expression $1.0\leq R/H2<1.5$ is established.

The inventors have performed a compression stress analysis using the finite element method based on large deformation theory, and found that when the non-spherical tank 2 is formed into a shape where an expression $R/H2<1.5$ is established, the non-spherical tank 2 possesses sufficient buckling resistance to compression stress generated in the vicinity of the toroidal portion 37. When the non-spherical tank 2 is formed into a shape where an expression $R/H2\geq1.0$ is established, the non-spherical tank 2 can maintain a sufficient capacity compared to a spherical tank.

According to the non-spherical tank 2 of this embodiment, at the connecting position C2 at which the first spherical shell portion 38 and the toroidal portion 37 are connected with each other, the tangential direction of the first spherical shell portion 38 and the tangential direction of the toroidal portion 37 agree with each other. Accordingly, the first spherical shell portion 38 and the toroidal portion 37 are smoothly connected with each other at the connecting position C2 of these portions. In the same manner, at the connecting position C3 at which the second spherical shell portion 36 and the toroidal portion 37 are connected with each other, the tangential direction of the second spherical shell portion 36 and the tangential direction of the toroidal portion 37 agree with each other. Accordingly, the second spherical shell portion 36 and the toroidal portion 37 are smoothly connected with each other at the connecting position C3 of these portions.

With such a configuration, it is possible to suppress the problem where compression stress is concentrated at the connecting position C2 at which the first spherical shell portion 38 and the toroidal portion 37 are connected with each other and at the connecting position C3 at which the second spherical shell portion 36 and the toroidal portion 37 are connected with each other.

It is desirable that the non-spherical tank 2 of this embodiment satisfies the following conditional expressions.

$$R/H1\leq1.45$$

$$R1/R2<2.5$$

$$R2/R>0.4$$

Here, "R1" denotes the first radius, and "R2" denotes the second radius.

The inventors have performed a compression stress analysis using the finite element method based on large deformation theory, and found that when the non-spherical tank 2 is formed into a shape where the above-mentioned conditional expressions are satisfied, the non-spherical tank 2 possesses reliable buckling resistance to compression stress generated in the vicinity of the toroidal portion 34. With such a configuration, it is possible to suppress the problem where compression stress is concentrated at the connecting position C1 at which the spherical shell portion 35 and the toroidal portion 34 are connected with each other.

EXPLANATION OF REFERENCE

1: liquefied gas carrier ship
2: non-spherical tank
31: circular cylindrical portion
32: top portion
33: bottom portion
34: toroidal portion (top-portion-side toroidal portion)
35: spherical shell portion (top-portion-side spherical shell portion)
36: second spherical shell portion (second-bottom-portion-side spherical shell portion)
37: toroidal portion (bottom-portion-side toroidal portion)
38: first spherical shell portion (first-bottom-portion-side spherical shell portion)
B: lower end
C1, C2, C3: connecting position
O1, O2, O3, O4: center position
T: upper end
X: axis

The invention claimed is:

1. A non-spherical tank for storing a liquefied gas, the non-spherical tank comprising:

a circular cylindrical portion extending along a vertical direction and having a cylindrical shape;

a top portion having a head plate structure where the top portion is disposed continuously with an upper side of the circular cylindrical portion and projects upward; and a bottom portion having a head plate structure where the bottom portion is disposed continuously with a lower side of the circular cylindrical portion and projects downward, wherein the top portion includes:

a top-portion-side spherical shell portion which is formed of a portion of a spherical body having a first radius, and is disposed at an upper end of the top portion; and a top-portion-side toroidal portion which is disposed continuously with the upper side of the circular cylindrical portion and with a lower side of the top-portion-side spherical shell portion, and is formed of a portion of a spherical body having a second radius smaller than the first radius, a center position of the spherical body having the first radius which forms the top-portion-side spherical shell portion is disposed on an extension of a line which connects a connecting position at which the top-portion-side spherical shell portion and the top-portion-side toroidal portion are connected with each other and a center position of the spherical body having the second radius which forms the top-portion-side toroidal portion, and a following conditional expression is satisfied:

$$1.2<R/H1\leq 1.45 \quad (1)$$

$$R1/R2<2.5 \quad (2)$$

$$R2/R>0.4 \quad (3)$$

where "R" denotes a radius of the circular cylindrical portion, "R1" denotes the first radius, "R2" denotes the second radius, and "H1" denotes a height of the top portion in the vertical direction.

2. The non-spherical tank according to claim 1, wherein a following conditional expression is satisfied:

$$1.0\leq R/H2<1.5 \quad (4)$$

where "H2" denotes a height of the bottom portion in the vertical direction.

3. The non-spherical tank according to claim 2, wherein the bottom portion includes:

a first-bottom-portion-side spherical shell portion which is formed of a portion of a spherical body having a third radius, and is disposed at a lower end of the bottom portion; and a bottom-portion-side toroidal portion which is disposed continuously with an upper side of the first-bottom-portion-side spherical shell portion, and is formed of a portion of a spherical body having a fourth radius smaller than the third radius.

4. The non-spherical tank according to claim 3, wherein a center position of the spherical body having the third radius which forms the first-bottom-portion-side spherical shell portion is disposed on an extension of a line which connects a connecting position at which the first-bottom-portion-side spherical shell portion and the bottom-portion-side toroidal portion are connected with each other and a center position of the spherical body having the fourth radius which forms the bottom-portion-side toroidal portion.

5. A liquefied gas carrier ship comprising:

the non-spherical tank according to claim 1; and a tank cover covering an upper half portion of the non-spherical tank, and extending along a bow-stern direction and along a ship width direction.

* * * * *